US005526579A

United States Patent [19]

Kade et al.

[11] Patent Number: 5,526,579

[45] Date of Patent: Jun. 18, 1996

[54] DRYER SECTION

[75] Inventors: Werner Kade, Neenah, Wis.; Wilfried Kraft; Wolfgang Mayer, both of Heidenheim; Gerhard Kotitschke, Steinheim, all of Germany

[73] Assignee: J.M. Voith GmbH, Germany

[21] Appl. No.: 19,144

[22] Filed: Feb. 17, 1993

[51] Int. Cl.[6] ..... F26B 11/02

[52] U.S. Cl. ..... 34/117; 34/116

[58] Field of Search ..... 34/114, 115, 116, 34/117, 120

[56] References Cited

U.S. PATENT DOCUMENTS

| | | | |
|---|---|---|---|
| 5,050,317 | 9/1991 | Kade et al. | 34/117 |
| 5,068,980 | 12/1991 | Mullen | 34/117 |
| 5,115,581 | 5/1992 | Viitanen | 34/117 |
| 5,177,880 | 1/1993 | Preisetanz et al. | 34/117 |
| 5,238,535 | 8/1993 | Kraft | 34/117 |
| 5,341,579 | 8/1994 | Schiel et al. | 34/117 X |

*Primary Examiner*—Henry A. Bennet
*Attorney, Agent, or Firm*—Ostrolenk, Faber, Gerb & Soffen

[57] ABSTRACT

The present invention relates to a dryer section of a machine for the production of fibrous web, such as a paper web. The dryer section comprises at least one dryer group having at least one drying cylinder and an endless porous support belt that guides the web around each cylinder. This is followed by a reversing roll being formed as a suction roll. With the web being supported by said porous support belt the web directly contacts said reversing roll. A distance of at least 150 mm is provided between the cylinder and the reversing roll. A sealing strip extends transversely over and close to the inner side of the endless porous belt in the region where web and belt are traveling off the cylinder. For deflecting the air boundary layer which arrives together with the belt, a sealing support beam also extends transversely over the inner side of the belt and supports the sealing strip. The beam, the sealing strip, the reversing roll and a section of the belt which is tangential to the cylinder and the reversing roll together define an area of negative pressure.

21 Claims, 2 Drawing Sheets

DRYER SECTION

BACKGROUND OF THE INVENTION

The present invention relates to a dryer section of a machine for the production of a fibrous web, for instance a paper web.

The dryer section comprises a plurality of dryer groups arranged one after another in a path of the web through the dryer section; each dryer group comprising at least one, and more usually a plurality of drying cylinders arranged in sequence of the path of the web. Typically, there is an endless porous support belt that passes the web around successive drying cylinders. Generally, each drying cylinder is followed by a reversing roll for guiding the support belt, e.g. onto the next drying cylinder in the path of the web through the drying section. The support belt partially wraps around each of the drying cylinders. The web is supported on the support belt so that the web directly contacts the drying cylinders, while the support belt directly contacts the reversing rolls. Typically, the reversing rolls are suction rolls.

The web should leave the drying cylinder with the support belt. As described below, appropriate suction means are provided for accomplishing that result.

The invention also relates to a dryer section with inclined rows of drying cylinders for shortening the structural length of the dryer section. In that case, the dryer cylinders are arranged in a plurality of rows and the web travel pathway, guided by the respective web support belts in the dryer groups is such that the web alternately passes down one row and up the next row through the dryer groups.

Such dryer section forms the object of U.S. Pat. No. 5,050,310. A traditional drying section has only horizontal rows of drying cylinders. In the just mentioned patent, it was attempted to shorten the structural length of the dryer section by arranging the dryer cylinders in predominantly vertical rows. Individual dryer cylinders are shifted out of the vertical row so as to produce a row which, although it is not linear, is inclined to the vertical. A forwardly inclined row is followed by a rearwardly inclined row so that the cylinder rows succeed each other in the manner of a zig-zag line.

The object of U.S. Pat. No. 5,177,880 is to further develop the proposed dryer section so that it can be installed easily and can be accessible in operation and, furthermore, so that the machine frames of the section are formed of simple parts.

This object is achieved by the following primary feature: The rows of dryer cylinders being oriented so that successive rows of dryer cylinders alternate, with one row being inclined from the vertical rearwardly and upstream in the path of the web through the dryer section and the next row being inclined from the vertical forwardly and downstream in the path of the web through the dryer section. Two adjacent oppositely inclined rows incline toward each other, with one pair of rows inclining toward each other vertically downward and the next pair or rows inclining toward each other vertically upward. Two rows inclined toward each other define a generally V-shaped double row.

Instead of there being a single dryer cylinder generally at the apex of the V, particularly in order to enable removal of break paper, the end or final dryer cylinder off of which the web comes from the upstream row and the start or first dryer cylinder in the next row in the V-shaped double row are arranged horizontally alongside each other.

It is therefore preferred that all, or at least nearly all, of the rows of cylinders have the same number of cylinders, and preferably three cylinders per row. Providing three cylinders Per row is already known from U.S. Pat. No. 4,744,156. In that case, however, all of the rows of cylinder are inclined in the same direction, namely all are inclined toward the rear or upstream or all toward the front or downstream. This has the disadvantage that the spaces between two adjacent rows of cylinders are very narrow. In contrast to this known arrangement, the cylinders of the invention are arranged along a "rack profile". This retains the previously relatively large spaces between the rows of cylinders, which enables the temporary removal and reinstallation of the an individual dryer cylinder. Furthermore, this provides space for known drying air blast and suction boxes at least at some of the reversing rolls, similarly to U.S. application Ser. No. 321, 761, now U.S. Pat. No. 4,986,009, which is mentioned in U.S. application Ser. No. 07/467,788, filed Jan. 19, 1990. For showing of such features, the disclosures of these U.S. specifications are incorporated herein by reference.

Although three dryer cylinders in each row, which has a plurality of dryer cylinders, is preferred, there may be as few as two or as many as four in a multi-cylinder row. The rows of dryer cylinders usually have about the same number of dryer cylinders. At least one of the dryer groups has at least two rows. At least one of the dryer groups may have only a single row. The dryer group has a single supporting belt which passes over all of the dryer in the dryers group. Two rows forming a V-shaped double row may be in a single dryer group or may be respective parts of two successive dryer groups.

A framework of beams and posts supports the rows of dryer cylinders. Preferably, that framework includes beams and posts that supports the dryer cylinders of two rows forming a V and particularly a V with its apex downward, wherein the lower cylinders are supported at a first lower plane, the upper cylinders of the two rows are supported at an upper plane and if there are central dryer cylinders between the support and lower dryer cylinders, the central cylinders are supported at a central plane. Appropriate means are provided for either articulating some of the beams or removing part of them to gain access to the particular dryer cylinders for easy replacement.

As appropriate, blast scrapers may be provided at the dryer cylinders, and air blast boxes at some of the reversing rolls.

A partition wall may extend between the rows of a double row of dryer cylinders and that partition wall may include channels for feeding drying air and/or be provided adjacent dryer cylinders for feeding drying air to the supporting belt and into the pocket between adjacent dryer cylinders.

SUMMARY OF THE INVENTION

It is an object of the present invention to improve the prior art dryer sections such that the so-called runability is increased, i.e. that less web breaks occur even at very high web speed (in the order of 1500 m/min to 2000 m/min). A further object is to reduce the energy consumption upon operation of the dryer section.

More specifically, it is the object of the present invention to improve the dryer section disclosed in U.S. Pat. No. 5,177,880 in the way mentioned above.

The primary feature of the invention comprises providing a relative large distance between at least one of the dryer cylinders and the following suction roll, said distance being at least 150 mm, preferably between 200 and about 500 mm, and providing a sealing strip which extends transversely over the inner side of the endless, porous web support belt in the region where web and belt travel off the cylinder, further providing a sealing support beam supporting said sealing strip and defining an area of negative pressure which area extends from said sealing strip, along the inner side of the support belt, to the region where the belt first contacts the periphery of the suction roll, said area communicating with the interior of the suction roll through the perforation provided in the suction roll shell.

A traditional dryer section lacks said sealing strip and sealing support beam and has a very small distance between the dryer cylinder and the following suction roll. Therefore, a high negative pressure is needed in the suction roll for both sucking off the air boundary layer which arrives together with the support belt and for providing a sufficient negative pressure on the inner side of the belt in the region where web and belt travel off the cylinder in order to draw the web as close as possible to the porous belt.

In contrast to that, according to the invention, the following is achieved: The air boundary layer is deflected by said sealing strip and is thereby kept away from the region where web and belt travel from the cylinder to the suction roll. As a result, the suction roll needs to suck off only a relatively small amount of air from said area of negative pressure. Therefore, turbulence of air is avoided in said area whereby the web is traveling more steadily than hitherto off the cylinder. That prevents wrinkles and web breaks. In other words, the web run is significantly improved.

As a further result, less energy is needed to create the negative pressure in the suction roll. Finally, the enlarged distance between cylinder and suction roll increases the distance wherein moisture evaporates from the web. Thus, the drying efficiency is also improved.

Other features and advantages of the present invention will become apparent from the following description of the invention which refers to the accompanying drawings.

BRIEF DESCRIPTION OF THE DRAWING(S)

DESCRIPTION OF THE PREFERRED EMBODIMENT

Figure 1:
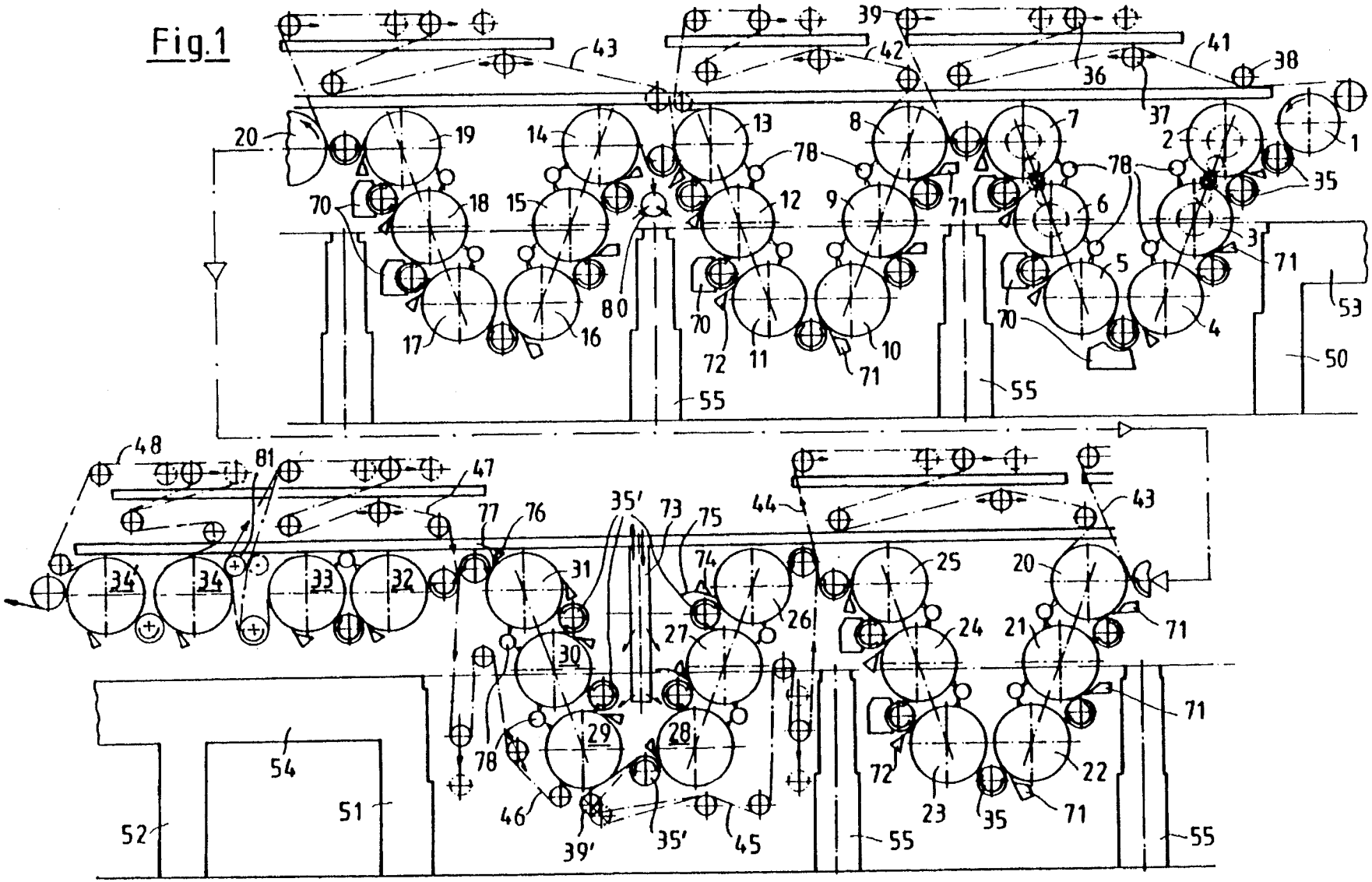
FIG. 1 is a diagrammatic side view of a dryer section.

The dryer section shown in FIG. 1 is a dryer section of a paper manufacturing machine for drying a web. The dryer section has a total of 35 heatable dryer cylinders.

A first dryer group having the first web supporting belt 41 comprises the dryer cylinders 1 to 7. Note that these dryer cylinders are in two rows inclined toward each other toward their bottom ends. This is true for most, if not all, of the other plural row dryer groups.

A second dryer group having the second web supporting belt 42 comprises the dryer cylinders 8 to 13.

A third dryer group having the third web supporting belt 43 comprises the dryer cylinders 14 to 19.

A fourth dryer group having the fourth web supporting belt 44 comprises the dryer cylinders 20 to 25.

A fifth dryer group having the fifth web supporting belt 45 comprises the dryer cylinders 26 to 28. Note that these dryer cylinders comprise only a single row.

A sixth dryer group having the sixth web supporting belt 46 comprises the dryer cylinders 29 to 31. These cylinders also comprise only a single row. The fifth and sixth groups together define a V-shaped double row of cylinders.

A seventh dryer group having the seventh web supporting belt 47 comprises the dryer cylinders 32 and 33.

An eighth (and last) dryer group having the eighth web supporting belt 48 has two dryer cylinders 34 and 34'.

Each of the supporting belts 41 to 48 is a so-called dryer wire. Except for the dryer cylinder 25, 31 and 34', a reversing roll 35, developed as a suction roll is arranged after or downstream of each dryer cylinder 1 to 34, and particularly between each two cylinders in each dryer cylinder group. Each reversing roll conducts its supporting belt from the preceding dryer cylinder in the group to the following dryer cylinder therein. Within each dryer group, the paper web travels, in continuous contact with the corresponding supporting belt 41 to 48, alternately over a dryer cylinder and then over the next reversing roll. The arrangement is such that the web comes into direct contact with the dryer cylinders with the supporting belt outside the web, while the supporting belt comes into contact with the reversing rolls with the web outside the belt.

For guiding its supporting belt, each dryer group includes, in customary manner, a tensioning roll 36, a regulating roll 37 and further guide rolls 38, 39. One of the guide rolls 39 can be mounted movably. See, for example, the first dryer group having the supporting belt 41.

Most of the dryer cylinders, namely the dryer cylinder 2 to 31, are arranged in several rows lying one after the other. Each row consists of three dryer cylinders. As an alternative, two or four cylinders per row could also be provided. Each of the rows of cylinders extends predominantly in the vertical direction, but it is inclined to the vertical. The first row 2–4 is inclined rearwardly or upstream, in the direction of web travel, the second row 5–7 is inclined forwardly or downstream in the direction of web travel, the third row 8–10 rearwardly, etc. In other words: every two consecutive inclined rows of cylinders form a V-shaped double row. As discussed elsewhere, some dryer groups include but one row, while other groups include more than one row. But, the successive rows form V-shaped double rows, with successive V's mutually inverted.

The rearward and forward inclined angles can be the same for the rearwardly inclined and the forwardly inclined rows of cylinders, for example, between 10° and 50°. As an alternative, the angles of inclination in a double row may differ, preferably such that the angle of inclination of the row which is inclined forwardly is greater than the angle of inclination of the row which is inclined rearwardly, as explained further below.

Compared with the dryer section of U.S. Pat. No. 5,050,317, wherein the cylinders and rolls are distributed and arrayed in a very tall stack, e.g. up to 15 m. tall, also having predominantly vertical rows of dryer cylinders, the arrangement according to the invention, provides an easily installed shorter height array of the cylinders which is readily accessible in operation and which the operator can easily survey because the height of the array is not excessive. Contributing to this is the fact that in each row, there are preferably three, possibly only two, but at most four cylinders arranged one above the other. Therefore, in order to further shorten the total structural height, no more than four cylinders are arranged one above the other. The selection of two or three cylinders per row enters primarily into consideration when cylinders of relatively large diameter (preferably more than 2 meters) are used.

The arrangement of the dryer cylinders is such that the end of each preceding row of cylinders and the starting cylinder of each following row of cylinders is not formed by the same single dryer cylinder, but instead by respective cylinders from the two rows, which are arranged horizontally alongside of each other. Note cylinders 4 and 5 and cylinders 7 and 8. One could thus say that the cylinders 2 to 31 are arranged one behind the other along a rack profile. One favorable consequence of this is that the number of rows of cylinders required does not become excessive and that more space is available between the rows.

In FIG. 1, the customary concrete columns 50 to 52 and longitudinal beams 53, 54 are seen. They support the frames (not shown) for the first dryer cylinder 1 and for the three last dryer cylinders 32 to 34. Also indicated in FIG. 1 are only a few posts 55, which may be made of concrete or of cast iron.

As an alternative, the first cylinder 1 may be replaced with an independent pre-dryer-group comprising, e.g., three or four cylinders and a separate support belt.

As can be noted from FIG. 1, the first dryer group having the first supporting belt 41 comprises, in addition to the first cylinder 1, two successive inclined rows of cylinders which form a V-shaped double row. Within the first dryer group, the bottom of the web comes into contact with the cylinders 1 to 7. Accordingly, the reversing rolls 35 lie predominantly below the space between the respective dryer cylinders adjacent each reversing roll or, more accurately, on the outside of the V formed by the rows of cylinders. This is favorable for the removal of any break paper which may be produced, since the break paper can simply fall downward from the reversing rolls onto the floor 57 of the cellar. The second, third and fourth dryer groups, having the respective supporting belts 42, 43 and 44, have the same features in accordance with FIG. 1.

Accordingly, the transfer of the web of paper from the first to the second dryer groups and from the third to the fourth dryer groups takes place as follows: The supporting belt, for instance 41, of the preceding first dryer group is tangent to the first dryer cylinder 8 of the following second dryer group and transfers the web of paper to the cylinder 8. An alternative to this is shown between the cylinders 13 and 14. Here, the supporting belt 43 of the following third dryer group is tangent to the last cylinder 13 of the preceding second dryer group in order to remove the web of paper from the cylinder 13. No turning over of the web of paper takes place at any of these transfer points. Instead in all of the dryer groups having the supporting belts 41 to 44, the same side of the web, namely its bottom side, comes into contact with the respective dryer cylinders.

In FIG. 1, still another V-shaped double row is provided with the cylinders 26 to 31. Differing from the preceding double rows, these rows form two dryer groups, independent of each other, each having the respective supporting belts 45 and 46, and there is a transfer place for the web from the supporting belt 45 to the cylinder 29. Between the cylinders 25 and 26, there is provided a known turn-transfer point where the web shifts from the supporting belt 44 to the supporting belt 45. This causes the top side of the web to come into direct contact with the cylinders 26 to 31 in the double rows having the supporting belts 45 and 46. In the latter rows, the reversing rolls 35' lie predominantly above the spaces between the respective adjacent dryer cylinders or, stated more precisely, on the inside of the V formed by the rows of cylinders. In order that any break paper produced can still be discharged downward, the guide roll 39' provided at the cylinder 29 for the supporting belt 45 is swingably mounted. This guide roll 39' can be moved away from the cylinder 29 into the position shown in dot-dash lines so that an open slot is produced between the cylinder 29 and the supporting belt 45.

In the center of the V-shaped double row having the cylinders 26 to 31, there is a partition wall 73, which extends from above between the two rows of cylinders. The partition wall 73 serves, on the one hand, to deflect break paper downward. On the other hand, channels can be provided in the partition wall 73 in order to feed drying air to the web of paper, primarily in the region of the reversing rolls 35'. The emerging drying air can then, in addition, assist in the transport of break paper downward. Further, channels can be provided in the partition wall 73 for discharge of exhaust air, like steam vapor and/or drying air which has absorbed water vapor. The streams of drying air and of exhaust air are indicated by arrows. Furthermore, on the cylinders 26, 27, 30 and 31, there can be specially shaped scrapers 74 which each have a guide plate 75, again for deflecting any break paper which is produced. A similar construction is provided in the case of an edge strip scraper 76 on the cylinder 31 on which a guide plate 77 is provided for deflecting the edge strip. In this way the threading of the edge strip into the dryer section can be facilitated.

Throughout the entire dryer section, a dry air blast tube 78 can be arranged between every two adjacent dryer cylinders for feeding drying air into the regions of the dryer cylinders which are covered by the web and the supporting belt and for feeding drying air into the pocket present between every two cylinders.

As can be noted from FIG. 1, a forwardly inclined row of cylinders (e.g. 11, 12, 13) and the following rearwardly inclined row of cylinders 14, 15, 16 together define a double row which has the form of a Δ (Delta). In the apex of such a double row, moisture laden air may be trapped during operation. If one would allow this air to just flow out at both sides of the machine, then the web drying process would be non-uniform in the cross machine direction. Therefore, an air suction device 80 is provided, e.g. in form of a perforated tube which extends transversely through the dryer section. Preferably, the tube may rotate at some low speed so that it is kept free from bits of paper or other material which would otherwise clog the perforations. At least one end of the tube is connected to a vacuum source. Within the tube, a series of baffles or a stationary duct is provided which defines an air discharge channel whose cross-section increases in the downstream direction. This ensures a uniform evacuation in the cross machine direction.

Between cylinders 25 and 26 as well as between cylinders 31 and 32, the web is transferred from one belt, e.g. 44, to the following belt 45 such that a short open, i.e. non-supported, web draw is provided, allowing a speed differential between the belts to reduce a longitudinal stress in the web; see U.S. applications Ser. Nos. 07/867,411 and 07/937,261 which are incorporated herein by reference.

Belt 47 is traveling around a shiftable belt roll 81. In this way, belt 47 may travel tangentially to cylinders 34 in normal operation or at a distance from cylinders 34 and from the web. In the latter case, a tail cutter symbolically shown as an arrow T may operate to produce a web tail for threading purposes.

Figure 2:
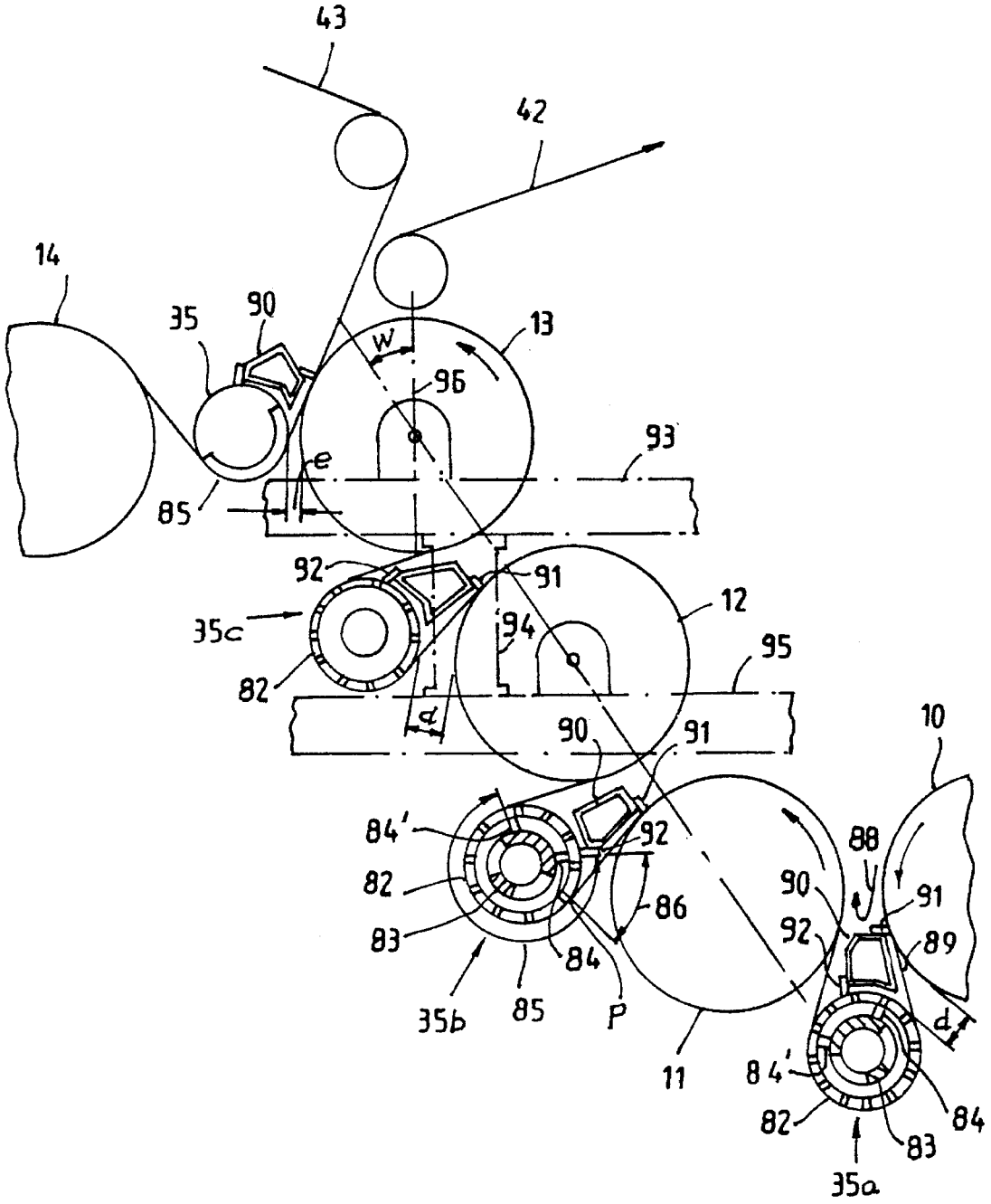
FIG. 2 is a larger scale detail from FIG. 1, also in side view.

While it is not possible for FIG. 1 to clearly show the above described primary feature of the invention, FIG. 2 depicts all details thereof. FIG. 2 shows, as an example, cylinders 10 to 14, support belts 42 and 43 and associated suction rolls 35*a* to 35*d*, each having a rotatable and perforated roll shell 82. Each of suction rolls 35*a*, 35*b* and 35*d* has an internal stationary suction box 83 (at 35*d* depicted only symbolically) with two longitudinal seals 84 and 84' defining a suction zone 85 which is larger than the so-called wrapping zone, the zone wherein belt 42 contacts roll shell 82. In particular, between the first seal 84 and the point P, where belt 42 comes into contact with roll shell 82, there is a so-called pre-suction zone 86.

The distance d (measured tangent to tangent, as seen in FIG. 2) between each of the cylinders 10 to 12 and the following suction roll 35*a*, 35*b* and 35*c*, respectively, is about 250 mm. The distance between each of the suction rolls and the following cylinders may be equal to or different from that value. The distance e between the last cylinder 13 of a dryer group and the first suction roll 35*d* of the following dryer group may be relatively small.

A first sealing strip 91 is disposed close to the inner side of porous belt 42, 43 in the region where web and belt leave each of the cylinders 10 to 13. More significantly, each of the first sealing strips 91 is disposed somewhat before the point where web and belt travel off the respective cylinder. Each of the first sealing strips 91 is supported by a sealing support beam 90 which also supports a second sealing strip 92. The latter is disposed close to that section of the periphery of the suction roll shell 82 which is not in contact with belt 42 or 43. Beam 90 and strips 91, 92 extend transversely through the full width of the machine. They define, together with roll shell 82 and together with a section of the belt 42 or 43, a gap 89 which communicates with the interior of the respective suction roll 35*a*–35*d*. As a result, the negative pressure prevailing in each of the suction rolls is transmitted into gap 89 so that the web, when leaving the respective cylinder 10 to 13, is safely attached to belt 42 or 43. This favorable result is achieved also due to the fact that the first sealing strip 91 deflects the air boundary layer (see arrow 88) and prevents the same from entering into gap 89.

The position of the second sealing strip 92 may be opposite the first one 91, as shown at suction roll 35*a*. However, it may be advantageous to dispose strip 92 close to the first longitudinal seal 84 as shown as suction roll 35*b*. That may result in a higher negative pressure in gap 89.

At 35*c*, a suction roll without a stationary internal suction box is shown. In this case, the second sealing strip 92 should be placed as close as possible to the point where belt 42 leaves the suction roll.

The advantages of the invention described hitherto may be achieved irrespective of the position of the dryer cylinders 10–14 within the dryer section, i.e. the axes of the cylinders may be arranged in a horizontal or in a vertical row. However, an additional advantage is achieved when at least one row of cylinders is inclined forwardly or rearwardly as described in view of FIG. 1. In particular, if the angle of inclination (w in FIG. 2) is relatively large (in the order of about 30°) the large distance d between a cylinder and the following suction roll has the following result: FIG. 2 shows schematically that cylinder 13 is supported by longitudinal beam 93. The latter is supported via stand 94 by further longitudinal beam 95. Now, the relative large distance d makes it possible to arrange stand 94 very close to the vertical centre plane 96 of cylinder 13. In other words, if distance d would be very small, i.e. if suction roll 35*c* would be shifted close to cylinder 12, then it would be necessary to shift stand 94 away from plane 96. Then the weight of cylinder 13 would create an unfavorable bending moment in longitudinal beam 93.

At least the first sealing strips 91 may be made yieldable according to the disclosure of U.S. application Ser. No. 07/989,207 of Dec. 12, 1992, which is incorporated herein by reference.

Each of the sealing support beams 90 is a hollow light weight structure having at each end a front wall (not shown) which extends close to the traveling path of belt 42 or 43 from the cylinder to the suction roll, in order to close gap 89 at both ends. Preferably, the interior of beams 90 is not connected to a source of pressure or vacuum. In this way, a considerable amount of energy can be saved if compared to said traditional dryer section. As explained above, it was found that, in many instances, the required steady web run off the cylinders is fully achieved even if gap 89 is evacuated via the suction roll only.

Nevertheless, in some instances, it may be required to provide within gap 89 a separate zone of higher negative pressure in the region where the belt separates from the cylinders, as disclosed in the above-mentioned U.S. application Ser. No. 07/989,207.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Dryer section of a machine for the production of fibrous web, comprising:

at least one dryer group having at least one drying cylinder and an endless porous support belt that guides the web around each cylinder which is followed by a reversing roll being formed as a suction roll, with the web being supported by said porous support belt and guided by the porous support belt around said reversing roll, a distance "d" of at least 150 mm being provided between the cylinder and the reversing roll, the distance "d" being measured tangent to tangent between the cylinder and the reversing roll, a sealing strip extending transversely over the endless porous belt in the region where web and belt are traveling off the drying cylinder, disposed for deflecting the air boundary layer which arrives together with the belt in a direction generally away from the drying cylinder and toward the reversing roll, a seal support beam also extending transversely over the inner side of the belt and supporting said sealing strip, said beam, said sealing strip, said reversing roll and a section of said belt which is tangential to the cylinder and the reversing roll together define a gap constituting a space of negative pressure, the suction roll including an internal suction box defining a suction zone in the suction roll, the suction zone including a pre-suction zone, said gap communicating with said pre-suction zone;

wherein the beam supports a further sealing strip that is disposed over the reversing roll, at a portion of the periphery not wrapped by the belt; and wherein said further sealing strip is disposed adjacent to said first longitudinal seal.

2. Dryer section of a machine for the production of fibrous web, comprising:

at least one dryer group having at least one drying cylinder and an endless porous support belt that guides the web around each cylinder which is followed by a reversing roll being formed as a suction roll, with the web being supported by said porous support belt and guided by the porous support belt around said reversing roll, a distance "d" of at least 150 mm being provided between the cylinder and the reversing roll, the distance "d" being measured tangent to tangent between the cylinder and the reversing roll, a sealing strip extending transversely over the endless porous belt in the region where web and belt are traveling off the drying cylinder, disposed for deflecting the air boundary layer which arrives together with the belt in a direction generally away from the drying cylinder and toward the reversing roll, a seal support beam also extending transversely over the inner side of the belt and supporting said sealing strip, said beam, said sealing strip, said reversing roll and a section of said belt which is tangential to the cylinder and the reversing roll together define a gap constituting a space of negative pressure, wherein the beam supports a further sealing strip which is disposed adjacent to a point where said belt leaves the suction roll.

3. Dryer section according to claim 2, wherein said sealing support beam is free from a connection to a source of pressure or vacuum.

4. Dryer section according to claim 2, wherein said space of negative pressure is connected to a vacuum source only via the perforations and the interior of said suction roll.

5. Dryer section according to claim 2 comprising:

a plurality of dryer groups arranged one after another in a path of the web through the dryer section; at least some of the dryer groups comprising a plurality of dryer cylinders;

a respective supporting belt for each dryer group, the supporting belt having one side on which the belt supports the web so that the web remains in continuous contact with the supporting belt moving through the dryer group over the dryer cylinders in the dryer group, the supporting belt being arranged so that the web on the one side of the supporting belt comes into direct contact with the dryer cylinders in the dryer group;

the dryer cylinders through the dryer groups being arranged in a plurality of rows so that the web alternately passes down one inclined row and up the next inclined row through the dryer groups; successive rows of dryer cylinders alternating, with one row being inclined from the vertical rearwardly and upstream in the path of the web through the dryer section and the next row being inclined from the vertical forwardly and downstream in the path of the web through the dryer section, whereby each two adjacent oppositely inclined rows incline toward each other, such that the row that is upstream in the path of the web through the dryer section has an end dryer cylinder off which the web comes before moving to the next downstream row; and the next row having a respective starting dryer cylinder which is the next dryer cylinder that the web contacts after leaving the end dryer cylinder of the next upstream row and two of the rows are respective successive pairs of the inclined rows being so inclined that the lower dryer cylinders thereof are nearer one another along a lower plane and the upper dryer cylinders thereof are spaced further apart from an upper plane.

6. The dryer section of claim 5, wherein each of the inclined rows of dryer cylinders is an essentially straight inclined row between the top dryer cylinder and the bottom dryer cylinder of the row.

7. Dryer section according to claim 5, wherein between a forwardly inclined row and a following rearwardly inclined row, there is disposed an air suction device extending transversely through the dryer section for sucking-off air uniformly in the cross machine direction.

8. Dryer section according to claim 1 wherein the suction zone is larger than a section of a periphery of the reversing roll which is wrapped by the belt so that the suction zone communicates with said space of negative pressure.

9. Dryer section according to claim 8, wherein the suction zone is defined by a first and a second longitudinal seal.

10. Dryer section according to claim 2, wherein the suction roll includes an internal suction box defining a suction zone in the suction roll, the suction zone including a pre-suction zone, said gap communicating with said pre-suction zone.

11. Dryer section according to claim 2, wherein said suction roll is free of any internal suction source.

12. Dryer section according to claim 1, wherein said sealing support beam is free from a connection to a source of pressure or vacuum.

13. Dryer section according to claim 1, wherein said space of negative pressure is connected to a vacuum source only via the perforations and the interior of said suction roll.

14. Dryer section according to claim 1 comprising:

a plurality of dryer groups arranged one after another in a path of the web through the dryer section; at least some of the dryer groups comprising a plurality of dryer cylinders;

a respective supporting belt for each dryer group, the supporting belt having one side on which the belt supports the web so that the web remains in continuous contact with the supporting belt moving through the dryer group over the dryer cylinders in the dryer group, the supporting belt being arranged so that the web on the one side of the supporting belt comes into direct contact with the dryer cylinders in the dryer group;

the dryer cylinders through the dryer groups being arranged in a plurality of rows so that the web alternately passes down one inclined row and up the next inclined row through the dryer groups; successive rows of dryer cylinders alternating, with one row being inclined from the vertical rearwardly and upstream in the path of the web through the dryer section and the next row being inclined from the vertical forwardly and downstream in the path of the web through the dryer section, whereby each two adjacent oppositely inclined rows incline toward each other, such that the row that is upstream in the path of the web through the dryer section has an end dryer cylinder off which the web comes before moving to the next downstream row; and the next row having a respective starting dryer cylinder which is the next dryer cylinder that the web contacts after leaving the end dryer cylinder of the next upstream row and two of the rows are respective successive pairs of the inclined rows being so inclined that the lower dryer cylinders thereof are nearer one another along a lower plane and the upper dryer cylinders thereof are spaced further apart from an upper plane.

15. The dryer section of claim 14, wherein each of the inclined rows of dryer cylinders is an essentially straight inclined row between the top dryer cylinder and the bottom dryer cylinder of the row.

16. Dryer section according to claim 14, wherein between a forwardly inclined row and a following rearwardly inclined row, there is disposed an air suction device extending transversely through the dryer section for sucking-off air uniformly in the cross machine direction.

17. Dryer section according to claim 11, wherein said sealing support beam is free from a connection to a source of pressure or vacuum.

18. Dryer section according to claim 11, wherein said space of negative pressure is connected to a vacuum source only via the perforations and the interior of said suction roll.

19. Dryer section according to claim 11 comprising:

a plurality of dryer groups arranged one after another in a path of the web through the dryer section; at least some of the dryer groups comprising a plurality of dryer cylinders;

a respective supporting belt for each dryer group, the supporting belt having one side on which the belt supports the web so that the web remains in continuous contact with the supporting belt moving through the dryer group over the dryer cylinders in the dryer group, the supporting belt being arranged so that the web on the one side of the supporting belt comes into direct contact with the dryer cylinders in the dryer group;

the dryer cylinders through the dryer groups being arranged in a plurality of rows so that the web alternately passes down one inclined row and up the next inclined row through the dryer groups; successive rows of dryer cylinders alternating, with one row being inclined from the vertical rearwardly and upstream in the path of the web through the dryer section and the next row being inclined from the vertical forwardly and downstream in the path of the web through the dryer section, whereby each two adjacent oppositely inclined rows incline toward each other, such that the row that is upstream in the path of the web through the dryer section has an end dryer cylinder off which the web comes before moving to the next downstream row; and the next row having a respective starting dryer cylinder which is the next dryer cylinder that the web contacts after leaving the end dryer cylinder of the next upstream row and two of the rows are respective successive pairs of the inclined rows being so inclined that the lower dryer cylinders thereof are nearer one another along a lower plane and the upper dryer cylinders thereof are spaced further apart from an upper plane.

20. The dryer section of claim 19, wherein each of the inclined rows of dryer cylinders is an essentially straight inclined row between the top dryer cylinder and the bottom dryer cylinder of the row.

21. Dryer section according to claim 19, wherein between a forwardly inclined row and a following rearwardly inclined row, there is disposed an air suction device extending transversely through the dryer section for sucking-off air uniformly in the cross machine direction.

* * * * *